US005864270A

United States Patent [19]

Hoffman

[11] Patent Number: 5,864,270

[45] Date of Patent: Jan. 26, 1999

[54] ELECTROMAGNETIC RELAY

[75] Inventor: Ralf Hoffman, Berlin, Germany

[73] Assignee: Siemens Aktiengesellschaft, Munich, Germany

[21] Appl. No.: 913,660

[22] PCT Filed: Mar. 5, 1996

[86] PCT No.: PCT/DE96/00385

§ 371 Date: Sep. 19, 1997

§ 102(e) Date: Sep. 19, 1997

[87] PCT Pub. No.: WO96/29720

PCT Pub. Date: Sep. 26, 1996

[30] Foreign Application Priority Data

Mar. 21, 1995 [DE] Germany ..... 195 10 252.5

[51] Int. Cl.[6] ..... H01H 51/22

[52] U.S. Cl. ..... 335/78; 335/80; 335/82; 335/86; 335/128; 335/129; 335/132; 335/202; 335/278

[58] Field of Search ..... 335/78–86, 202, 335/278, 128, 129, 132

[56] References Cited

U.S. PATENT DOCUMENTS

| | | | |
|---|---|---|---|
| 4,761,627 | 8/1988 | Bell | 335/128 |
| 5,204,647 | 4/1993 | Nagamoto et al. | 335/80 |

FOREIGN PATENT DOCUMENTS

| | | |
|---|---|---|
| 82 13235 | 7/1982 | France . |
| 89 14 910.6 | 12/1989 | Germany . |
| 90 16 264.1 | 11/1990 | Germany . |
| 92 10 790.7 | 8/1992 | Germany . |

*Primary Examiner*—Lincoln Donovan
*Assistant Examiner*—Tuyen T. Nguyen
*Attorney, Agent, or Firm*—Hill & Simpson

[57] ABSTRACT

In the case of the relay, an insulating wall which has at least three insulating layers is formed between the magnet system and a live metal part, in that the insulating wall is formed from a wall base having at least one insulating gap, and in that the insulating layer is formed in the insulating gap by insulating material which is inserted in liquid form and is subsequently cured.

34 Claims, 2 Drawing Sheets

ELECTROMAGNETIC RELAY

The invention relates to an electromagnetic relay having an insulating wall which is arranged between the magnet system on one side and the contact arrangement on the other side with a plurality of insulating layers. In addition, the invention relates to a method for producing such a relay.

Specific minimum distances must be maintained by insulation for safe electrical isolation between those parts of a relay which are at mains voltage, on the one hand, and other parts which can be touched and the metal parts of the magnetic circuit. This minimum distance is controlled by appropriate standards and regulations. For example, the insulating distances can be implemented by simple insulation by means of an integral insulating wall, in which case this insulating wall must not have less than a specific minimum thickness. Another option is for the insulating wall to be formed from, for example, at least three individual layers, the wall thickness of these individual layers then no longer being specified. The dielectric strength of the individual layers must then be verified separately in each case. With the increasing requirement for miniaturization of electrical components in general and relays in particular, attempts are therefore being made to comply with the insulation requirements by the formation of multilayer insulating walls having individual layers which are as thin as possible.

For example, the Utility Model DE 9210790 U1 proposes that base insulation and additional insulation with appropriate dielectric strength values be formed by two cap parts which are interleaved in one another. However, the production and folding of these cap parts requires complex procedures and, in addition, does not provide optimum space utilization either.

A relay of the type mentioned initially has also already been described in Utility Model DE 8914910 U1. An insulating wall which comprises three insulating layers is implemented, inter alia, there in that two walls having an intermediate pocket are formed on a first insulating part, it being possible to plug the third wall, in the form of a film, into the pocket. Thus, in this case, the film must be produced, cut and inserted as an additional part. In order to ensure problem-free insertion of this film, the gap width in the pocket may not be chosen to be indefinitely small.

The object of the present invention is therefore to design a relay of the type mentioned initially such that an insulating wall having a plurality of layers can be designed to be as thin as possible and can be produced in a manner which is as simple as possible.

SUMMARY OF THE INVENTION

This is achieved according to the invention in that the insulating wall is formed from a wall base having at least one insulating gap which extends in a plane provided for an insulating layer, and in that the insulating layer is formed in the insulating gap by insulating material which is inserted in liquid form and is subsequently cured.

As a result of the design according to the invention, only a single molding is thus necessary which forms, for example, two insulating layers with the said gap, it also being possible for this wall base to be an integral part of a relay base body which, for example, is fitted with the magnet system and/or accommodates the contact elements. One or even more additional insulating layers are formed simply by inserting the liquid insulating material into the gap or into the gaps. Depending on the circumstances, this may not require an additional manufacturing step, since liquid potting compounds generally have to be inserted anyway, in order to seal the relay.

An additional insulating layer can, for example, also be produced by inserting the liquid insulating material into a base body gap, which is otherwise intended for accommodating a contact support. In this case, it is only necessary to ensure that the contact support is positioned in the gap on the side remote from the required insulating wall, such that the contact support does not adversely affect the formation of the multilayer insulating wall. The width of the insulating gap can be selected to be as small as the molding tool, for example the minimum possible blade width of a mold insert, allows. The liquid insulating material may flow into the insulating gap by virtue of its own weight or may be injected under pressure, depending on the circumstances and its viscosity. The capillary effect of the insulating gap in this case also helps to convey the liquid insulating material into the inner end of the gap. A vent opening is expediently provided in the wall base, in the region of the inner end.

Accordingly, the present invention provides an electromagnetic relay that comprises a base, a magnet system, a contact arrangement and an insulating wall disposed between the magnet system and the contact arrangement. In a preferred embodiment, the insulating wall is formed from an extension of the base and comprises a plurality of insulating layers one of which is a first insulating gap for accommodating a liquid insulating material that is injected into the gap during manufacture and which is subsequently cured into a solid state.

In an embodiment, the first insulating gap is disposed between two insulating layers which are formed from the extension of the base.

In an embodiment, one of said insulating layers which is formed from an extension of the base is disposed between the first insulating gap and a second insulating gap. In a preferred embodiment, the second insulating gap is at least partially filled with insulating material.

In a preferred embodiment, the second insulating gap loosely accommodates a contact support so that liquid insulating material may be injected into a portion of the second insulating gap disposed between the contact support and the magnet system.

In an embodiment, the first insulating gap comprises a vent extending through the insulating wall which permits air and excess insulating material to escape.

In an embodiment, the second insulating gap also comprises a vent extending through the insulating wall. In an embodiment, the insulating wall is further characterized as being an insulating extension of the base which comprises at least two insulating walls with a first insulating gap disposed therebetween.

A method according to the invention for producing such a relay consists in that a base body having a base part, an insulating wall which projects upwards from the base part and has plug-in channels for contact supports, and having at least one insulating gap in the region of the insulating wall is formed from insulating material, in that the contact arrangement and the magnet system are attached to the base body, and in that finally the insulating gap is filled with a liquid insulating material, and this insulating material is then cured.

BRIEF DESCRIPTION OF THE DRAWINGS

The invention is explained in more detail in the following text and drawing with reference to an exemplary embodiment.

It should be understood that the drawings are not necessarily to scale and that the embodiments are sometimes illustrated by graphic symbols, phantom lines, diagrammatic representations and fragmentary views. In certain instances, details which are not necessary for an understanding of the present invention or which render other details difficult to perceive may have been omitted. It should be understood, of course, that the invention is not necessarily limited to the particular embodiments illustrated herein.

DETAILED DESCRIPTION OF THE PRESENTLY PREFERRED EMBODIMENTS

Figure 1:
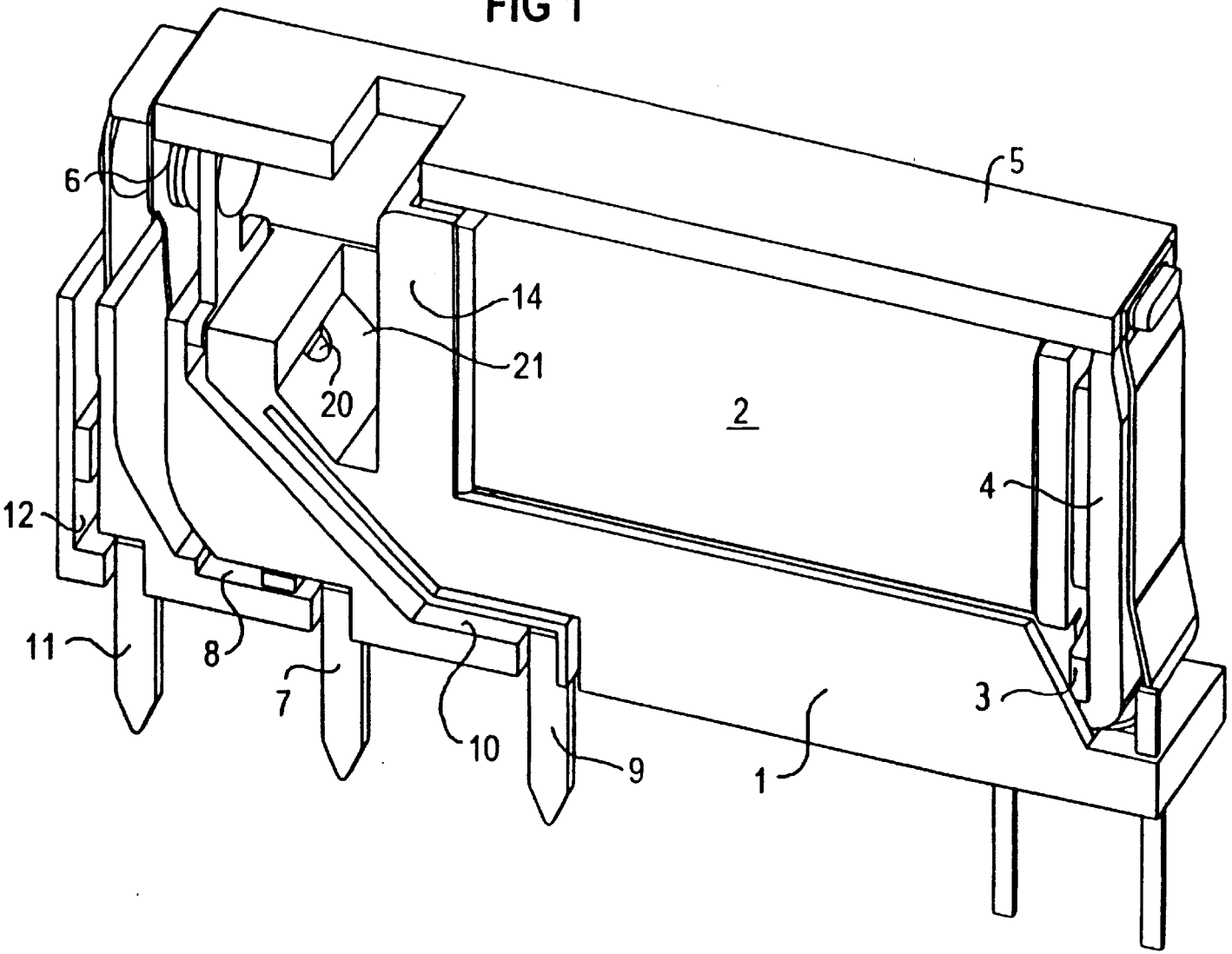
FIG. 1 is a perspective view of a relay designed according to the present invention, without a cap.
Figure 2:
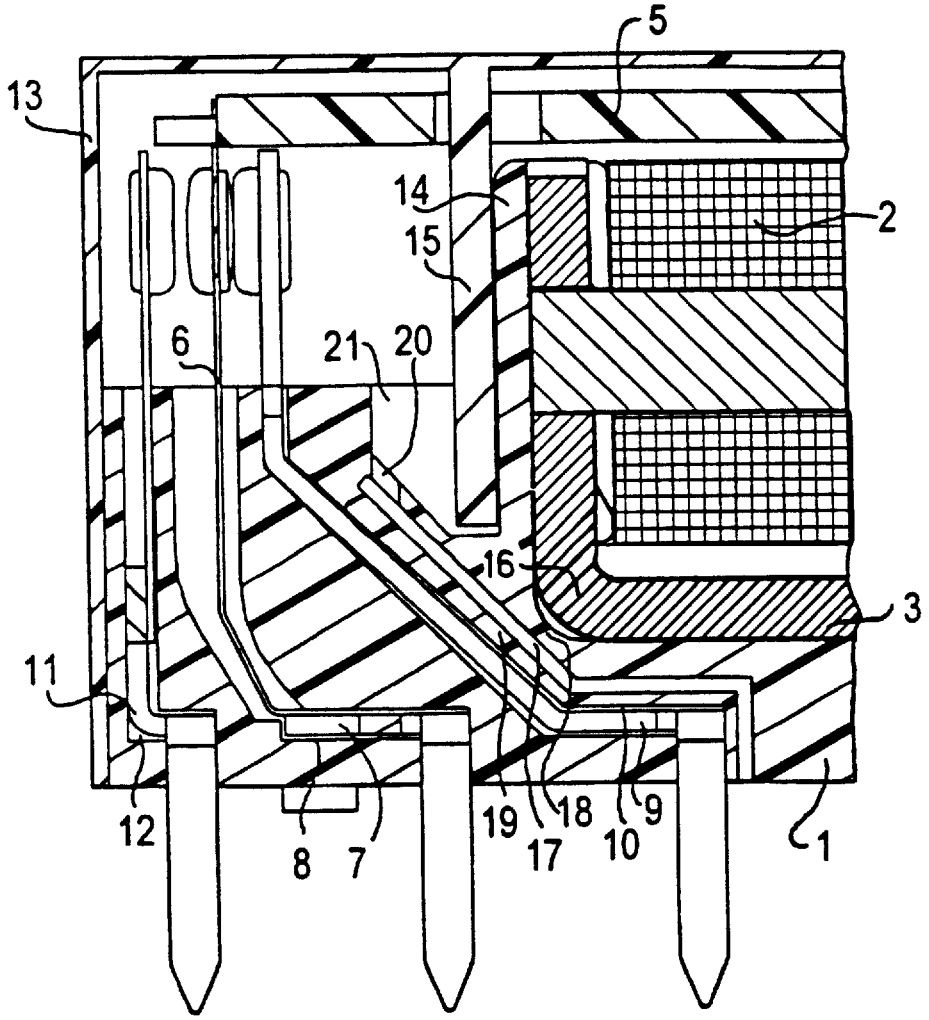
FIG. 2 is a side sectional view of the relay shown in FIG. 1.

The relay which is shown in FIGS. 1 and 2 has a base body 1 made of insulating material on which a magnet system is arranged having a coil 2, a bent yoke 3 and an armature 4. The armature 4 operates a contact spring 6 via a slide 5, and the contact spring 6 is anchored in a slot 8 in the base body 1 via a spring support 7. A break contact support 9 is anchored in a slot 10 in the base body, and a make contact support 11 is anchored in a corresponding manner in a slot 12 in the base body 1. Together with the base body 1, an insulating material cap 13 forms a closed housing.

A separating wall 14 is also integrally formed on the base body 1 and, together with a cap wall 15 which projects downwards, forms two-layer insulation between the yoke and the contact-making end of the make contact support 9. In addition, the distance is relatively large anyway in this region, so that the required insulating distances are maintained.

In contrast, the distance between the bend region 16 of the yoke 3 and the make contact support 9 is critical. This make contact support 9 is drawn obliquely to the right with respect to the contact-making end in order to maintain a desired large distance between the connecting pins of the contact elements. In order now to satisfy the insulation requirement with three insulating layers, an insulating gap 17 is cut out in the base body 1 in the said critical region, which insulating gap 17 is subsequently filled with liquid insulating material. After curing, this insulating material in the gap 17 forms an additional insulating layer between the wall layers 18 and 19 formed by the base body. In order that no build-up of air occurs in the interior of the insulating gap 17 when the additional liquid insulating material is being injected or inserted, a vent opening 20 is provided to the interior of the base body. Excess insulating material can pass through this vent opening 20 into the cavity 21, and can cure there.

In addition, insulating material could also be inserted in the fastening slot 10 of the make contact support 9 in order to form a further insulating layer. However, in this case, it is necessary to take care that the contact support 9 is positioned within the slot 10 on the wall remote from the yoke in order that the inserted insulating material is actually located as an effective insulating layer between the contact support 9 and the yoke 3.

The additionally inserted insulating material for forming the additional insulating layer can also be introduced simultaneously with the potting of the base side for sealing the contact support slots 8, 10 and 12.

Although modifications and changes may be suggested by those skilled in the art, it is the intention of the inventors to embody within the patent warranted hereon all changes and modifications as reasonably and properly come within the scope of their contribution to the art.

What is claimed:

1. An electromagnetic relay comprising:

a base comprising a lower portion, a magnet system, a contact arrangement, an insulating wall disposed between the magnet system and the contact arrangement, the insulating wall comprising a plurality of insulating layers, the insulating wall being formed from an extension of the base, the insulating wall further comprising a first insulating gap for accommodating a liquid insulating material for forming at least one of the insulating layers, the insulating gap extending upward from the lower portion of the base whereby the insulating material may be inserted through the lower portion of the base and into the gap, the liquid insulating material being subsequently cured into a solid state.

2. The relay of claim 1 wherein the first insulating gap is disposed between two insulating layers which are formed from the extension of the base.

3. The relay of claim 1 wherein one of the insulating layers that are formed from the extension of the base is disposed between the first insulating gap and a second insulating gap.

4. The relay of claim 3 wherein the second insulating gap accommodates a liquid insulating material for forming one of the insulating layers, the liquid insulating material being subsequently cured into a solid state.

5. The relay claim 1 wherein the insulating wall is an integral part of the base and accommodates the magnet system and the contact arrangement.

6. The relay of claim 5 wherein the insulating wall extends upwards from an end of the base so that the magnet system rests with a coil axis parallel to the base on one side of the insulating wall, the contact arrangement comprising three contact supports which are anchored in three respective slots in the base on an opposing side of the insulating wall from the magnet system.

7. The relay of claim 1 wherein the first insulating gap comprises a vent extending through the insulating wall.

8. The relay of claim 3 wherein the second insulating gap comprises a vent extending through the insulating wall.

9. The relay of claim 3 wherein the second insulating gap accommodates a contact support, the second insulating gap having a width that exceeds a thickness of the contact support, a portion of the second insulating gap disposed between the contact support and the magnet system being filled with the liquid insulating material.

10. An electromagnetic relay comprising:

a base comprising a lower portion, a magnet system, a contact arrangement, the base comprising an insulating extension disposed between the magnet system and the contact arrangement, the insulating extension comprising two insulating layers with a first insulating gap disposed therebetween, the insulating gap extending upward from the lower portion of the base whereby the insulating material may be inserted through the lower portion of the base and into the gap.

11. The relay of claim 10 wherein the first insulating gap accommodates a liquid insulating material for forming a first insulating layer, the liquid insulating material being subsequently cured into a solid state.

12. The relay of claim 10 wherein one of the insulating walls is disposed between the first insulating gap and a second insulating gap.

13. The relay of claim 12 wherein the second insulating gap accommodates a liquid insulating material for forming a second insulating layer, the liquid insulating material being subsequently cured into a solid state.

14. The relay claim 10 wherein the insulating extension is an integral part of the base and engages both the magnet system and the contact arrangement.

15. The relay of claim 5 wherein the insulating extension extends upwards from an end of the base so that the magnet system rests with a coil axis parallel to the base on one side of the insulating extension, and the contact arrangement comprising three contact supports which are anchored in three respective slots in the base on an opposing side of the insulating extension from the magnet system.

16. The relay of claim 10 wherein the first insulating gap comprises a vent extending through the insulating wall.

17. The relay of claim 12 wherein the second insulating gap comprises a vent extending through the insulating extension.

18. The relay of claim 12 wherein the second insulating gap accommodates a contact support, the second insulating gap having a width that exceeds a thickness of the contact support, a portion of the second insulating gap disposed between the contact support and the magnet system being filled with the liquid insulating material.

19. An electromagnetic relay comprising:

a base, a magnet system, a contact arrangement, an insulating wall disposed between the magnet system and the contact arrangement, the insulating wall comprising a plurality of insulating layers, the insulating wall being formed from an extension of the base, the insulating wall further comprising a first insulating gap for accommodating a liquid insulating material for forming at least one of the insulating layers, the first insulating gap comprising a vent that extends through the insulating wall, the liquid insulating material being subsequently cured into a solid state.

20. The relay of claim 19 wherein the first insulating gap is disposed between two insulating layers which are formed from the extension of the base.

21. The relay of claim 19 wherein one of the insulating layers that are formed from the extension of the base is disposed between the first insulating gap and a second insulating gap.

22. The relay of claim 21 wherein the second insulating gap accommodates a liquid insulating material for forming one of the insulating layers, the liquid insulating material being subsequently cured into a solid state.

23. The relay claim 19 wherein the insulating wall is an integral part of the base and accommodates the magnet system and the contact arrangement.

24. The relay of claim 23 wherein the insulating wall extends upwards from an end of the base so that the magnet system rests with a coil axis parallel to the base on one side of the insulating wall, the contact arrangement comprising three contact supports which are anchored in three respective slots in the base on an opposing side of the insulating wall from the magnet system.

25. The relay of claim 21 wherein the second insulating gap comprises a vent extending through the insulating wall.

26. The relay of claim 21 wherein the second insulating gap accommodates a contact support, the second insulating gap having a width that exceeds a thickness of the contact support, a portion of the second insulating gap disposed between the contact support and the magnet system being filled with the liquid insulating material.

27. An electromagnetic relay comprising:

a base, a magnet system, a contact arrangement, the base comprising an insulating extension disposed between the magnet system and the contact arrangement, the insulating extension comprising two insulating layers with a first insulating gap disposed therebetween, the first insulating gap comprising a vent that extends through the insulating extension.

28. The relay of claim 27 wherein the first insulating gap accommodates a liquid insulating material for forming a first insulating layer, the liquid insulating material being subsequently cured into a solid state.

29. The relay of claim 27 wherein one of the insulating walls is disposed between the first insulating gap and a second insulating gap.

30. The relay of claim 29 wherein the second insulating gap accommodates a liquid insulating material for forming a second insulating layer, the liquid insulating material being subsequently cured into a solid state.

31. The relay claim 27 wherein the insulating extension is an integral part of the base and engages both the magnet system and the contact arrangement.

32. The relay of claim 27 wherein the insulating extension extends upwards from an end of the base so that the magnet system rests with a coil axis parallel to the base on one side of the insulating extension, and the contact arrangement comprising three contact supports which are anchored in three respective slots in the base on an opposing side of the insulating extension from the magnet system.

33. The relay of claim 29 wherein the second insulating gap comprises a vent extending through the insulating wall.

34. The relay of claim 29 wherein the second insulating gap accommodates a contact support, the second insulating gap having a width that exceeds a thickness of the contact support, a portion of the second insulating gap disposed between the contact support and the magnet system being filled with the liquid insulating material.

* * * * *